United States Patent [19]

Cassimally et al.

[11] 4,273,222

[45] Jun. 16, 1981

[54] COMBINED PORTABLE CASE AND LUGGAGE TROLLEY

[75] Inventors: K. A. I. Cassimally, 402 Hayes Rd., Fort Pierce, Fla. 33450; Horace Frommelt, Fort Pierce, Fla.

[73] Assignee: K. A. I. Cassimally, Fort Pierce, Fla.

[21] Appl. No.: 68,867

[22] Filed: Aug. 22, 1979

[51] Int. Cl.[3] ..... A45C 5/14

[52] U.S. Cl. ..... 190/18 A; 280/37

[58] Field of Search ..... 190/18 A; 280/37, 638, 280/645, 38

[56] References Cited

U.S. PATENT DOCUMENTS

| | | | |
|---|---|---|---|
| 1,125,441 | 1/1915 | Bailey . | |
| 2,463,713 | 3/1949 | Partiot . | |
| 2,581,417 | 1/1952 | Jones . | |
| 3,709,513 | 1/1973 | Cassimally | 280/37 |
| 3,842,953 | 10/1974 | Royet . | |
| 3,917,038 | 11/1975 | Foge | 190/18 A |
| 3,960,252 | 6/1976 | Cassimally | 190/18 A |
| 4,026,569 | 5/1977 | Staal | 190/18 A X |

FOREIGN PATENT DOCUMENTS

| | | |
|---|---|---|
| 867582 | 11/1941 | France . |
| 448094 | 6/1936 | United Kingdom . |
| 1099200 | 1/1968 | United Kingdom . |

*Primary Examiner*—Donald F. Norton

*Attorney, Agent, or Firm*—Wegner, Stellman, McCord, Wood & Dalton

[57] ABSTRACT

A combined portable case and luggage trolley which, in its preferred form, includes a rigid frame which, when folded, engages a face of the case to become an integral part thereof and which is extendable therefrom to form a luggage support in cooperation with a spaced pair of frame support arms pivotally connected to the case. When extended, the rigid frame is alignable with the support arms in a common plane to define a luggage receiving framework in cooperation with the case. Wheels are mounted within recesses in the case for selective extension in association with extension of the framework.

20 Claims, 20 Drawing Figures

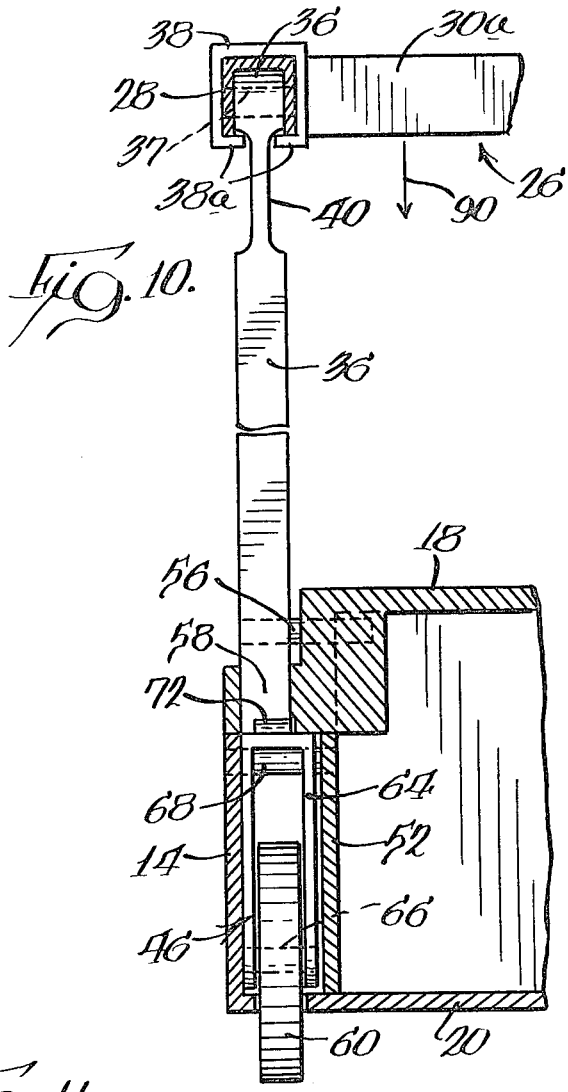
Fig. 10.
Fig. 11.
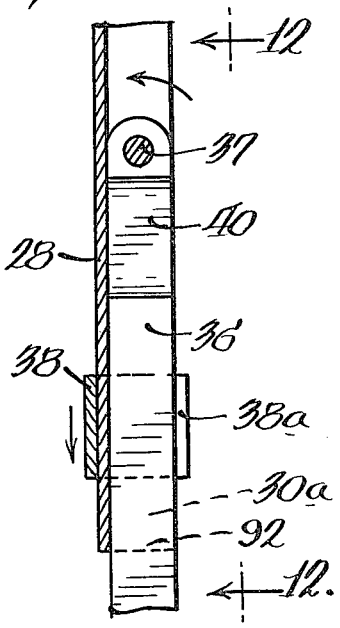
Fig. 12.
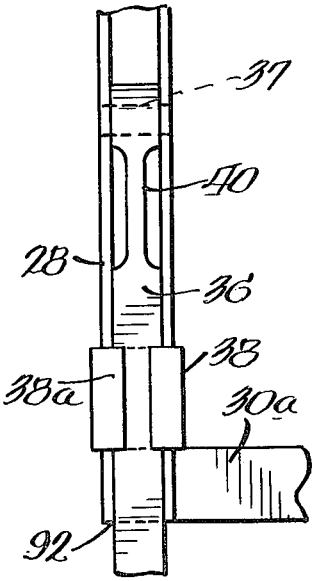

COMBINED PORTABLE CASE AND LUGGAGE TROLLEY

BACKGROUND OF THE INVENTION

This invention relates to a luggage trolley including a foldable framework associated with a portable case which, when the framework is extended from the case, will retain luggage placed between the extended framework and the portable case.

U.S. Pat. No. Re. 28,757, reissued Apr. 6, 1976 and corresponding to original U.S. Pat. Nos. 3,709,513 issued Jan. 9, 1973, and 3,960,252, issued June 1, 1976, both issuing to K.A.I. Cassimally, provide examples of portable luggage cases with an extendable framework which cooperates with the luggage case to form a trolley to receive and retain luggage. The trolley of U.S. Pat. No. Re. 28,757 and U.S. Pat. No. 3,709,513 includes a framework comprising a handle and a pair of wheels which can be folded into a closed position adjacent the exterior of the sides and one face of a portable case. When unfolded into an open position, the wheels project below the case and the framework projects outwardly therefrom and is locked to form a wheeled trolley.

The trolley of U.S. Pat. No. 3,960,252 discloses a framework which may be stored in a flat condition solely within one face of the portable case and which is easily separable therefrom to allow the case to be carried without the framework, if desired. This structure is effected by providing a telescoping handle which may be folded upon one face of the case to which is attached a pair of pivotal wheel assemblies which may also be folded into wheel recesses in the case storage face. The entire framework is received by sockets in the case which receives bar-like extensions of the framework.

Although the above-described luggage trolleys have many advantages, it has been considered desirable to produce a combined portable luggage case and wheeled luggage trolley wherein the framework forms an integral part of the case structure and which, if use of the trolley is not desired, does not require removal and separate storage thereof. Further, for economy of manufacture, reduction in weight and strength, it has been considered desirable to eliminate the telescoping framework elements.

SUMMARY OF THE INVENTION

According to the present invention, a wheeled portable case is provided with a rigid frame selectively engageable with a face of the case such as, in the preferred embodiment, the lid of the case. Upon selective disengagement of the frame from the case face, the rigid frame may be aligned in coplanar relationship with a pair of rigid, coplanar frame support arms pivotally connected to and adjacent one end of the case. The support arms may be disposed substantially perpendicularly to the face of the luggage case and the rigid frame aligned therewith. Locking means retain the rigid frame and the support arms in coplanar alignment.

To provide mobility, a pair of wheels are mounted within recesses located at the end of the case at which the support arms are connected. The wheels are mounted to be selectively retractable and extendable with respect to the recesses and are associated with the support arms to be urged outwardly when the arms are pivoted to their open position. Means on the wheel support engage the support arms to retain the wheels in their extended position during use. Alternatively, the wheels may be independent of the support arms and moved to the extended or retracted positions manually.

The improved trolley structure of the present invention results in an esthetically pleasing case which provides for enhanced ease of manufacture, increased portability, and improved security during transport.

BRIEF DESCRIPTION OF THE DRAWINGS

FIG. 10 is a vertical section of the luggage case framework of FIG. 9 taken along line 10—10 thereof;

FIG. 11 is a vertical section of a portion of the framework of FIG. 9 with the frame shown in the fully extended position;

FIG. 12 is a vertical elevation of the extended framework of FIG. 11 taken along line 12—12;

DESCRIPTION OF THE PREFERRED EMBODIMENTS

Figure 1:
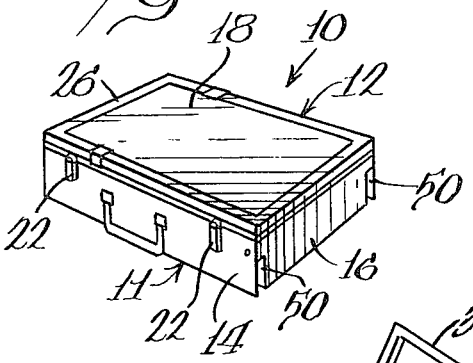
FIG. 1 is a perspective view of a combined portable case and luggage trolley with trolley framework shown in a folded position.

FIGS. 1-4 illustrate an exemplary embodiment of the combined portable case and luggage trolley of the invention. The combined portable case and trolley, generally designated 10, comprises a portable case 11 and a foldable framework 12 connected thereto as described below. The case 11 is formed of joined side walls 14, end walls 16, a bottom wall (not shown) and a lid 18 hinged to a side wall 14. A pair of luggage locks 22 secure the lid 18 in a closed position.

The foldable framework, generally designated 12, comprises a rigid continuous frame 26 selectively engageable with a face, such as the lid 18, of the case 11. The frame 26 illustratively and preferably comprises a rectangular frame formed by joined pairs of side and end bars 28 and 30, respectively. In the embodiment of FIGS. 1–4, the rigid frame 26 conforms with and is receivable by a peripheral groove or ledge 34 about the lid 18. This results in the frame appearing to be part of the case.

Pivotally connected to opposite sides of the lid 18 adjacent one end 16 of the case 11 are rigid frame support arms 36 (details of the connection between the support arms 36 and the case 11 are described in detail below, with reference to FIGS. 5–9). The opposite ends of the support arms 36 are pivotally connected to the sides 28 of the rigid frame 26.

The points of connection between the support arms 36 and the frame side elements 28 are spaced from the frame end elements 30 such that the frame 26 will engage the ledge 34 when the support arms 36 are folded parallel to the case 11.

In the preferred embodiment, each frame side and end element 28 and 30 comprises a U-shaped channel having its open side facing downwardly against the lid 18. A pair of C-shaped locking slides 38 are received along each side channel 28. Each support arm 36 includes a segment of reduced thickness 40 below its point of connection with the frame 26.

With the frame 26 placed in engagement with the peripheral ledge 34, the support arms 36 extend along the ledge 34 and are received within the U-shaped channels 28. The locking slides 38 have inwardly directed lips **38*a* (see FIGS. 10–12) which are received by the reduced segments 40. Indentations 42 are provided in the lid ledge 34 to receive the increased thickness of the slides 38. Further frame locking means (not shown) are provided to secure the rigid frame 26 to the case 11**.

Figure 2:
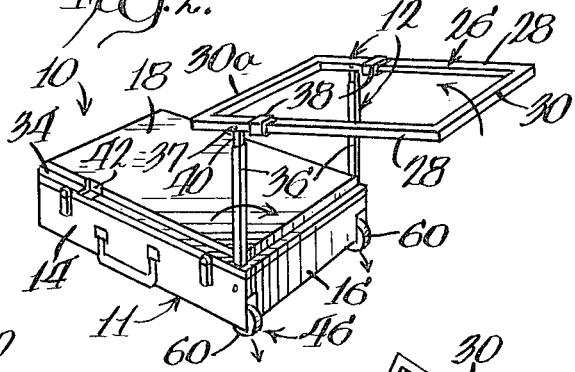
FIG. 2 is a perspective of the case and trolley of FIG. 1 with the framework shown in partially extended condition.
Figure 3:
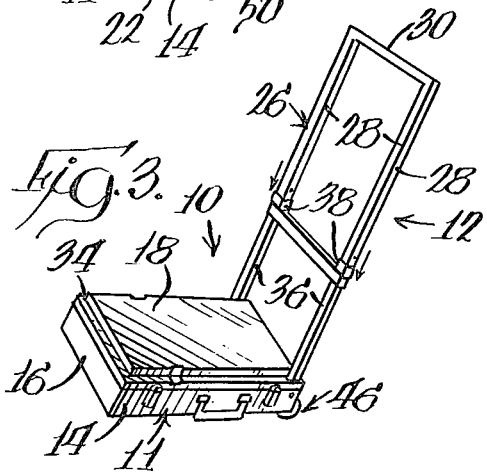
FIG. 3 is a perspective of the case and trolley of FIGS. 1 and 2 with the trolley framework and wheels shown in their fully extended positions.

When conversion from a portable case to a luggage trolley is desired, the frame is released from the case 11 and the support arms 36 are swung upwardly in the direction of the arrow of FIG. 2, and the rectangular frame 26 is rotated, as shown in FIG. 2, into coplanar alignment with the arms 36. The coplanar extended relationship of the support arms 36 and the frame 26 is shown in FIG. 3. The lower end channel **30*a* of the frame 26 is relieved (not shown in FIGS. 1–4) adjacent its connection to the side members 28 to permit the support arms 36 to pass channel 30*a* and extend in the same direction as the side channels 28**.

When the frame 26 is disposed in coplanar alignment with the arms 36, the locking slides 38 are moved downwardly, as shown in FIG. 3, to retain the channels 28 and the support arms 36 in alignment. Means (not shown in FIGS. 1–4) are provided to maintain the arms 36 in substantially perpendicular alignment to the lid 18. Further, wheels 46 are provided, illustratively on the bottom of the case 11, to facilitate rolling movement of the trolley case 10.

Figure 4:
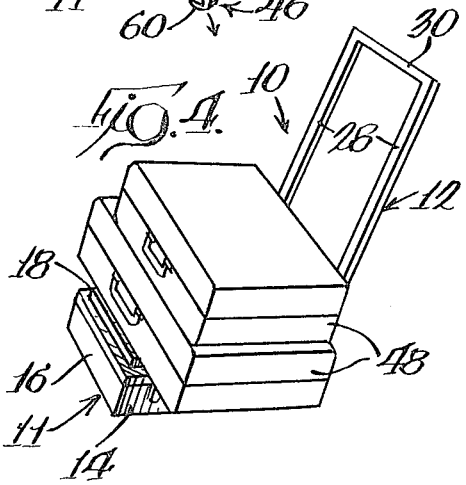
FIG. 4 is a perspective of the case and trolley of FIGS. 1-3 with luggage retained between a case and extended framework.

As seen in FIG. 4, several pieces of luggage 48 may be disposed between the lid surface 18 and the extended trolley frame 12 for transport. It will be appreciated by those skilled in the art that, with the frame 12 retained in perpendicular relation to the case 11, the case 11 may be tilted upwardly from the underlying terrain supported by wheels 46.

FIGS. 5–9 illustrate one embodiment of a wheel assembly utilizable with the combination case and trolley of the invention. Although conventional wheels or other motive support means may be secured to the bottom of the case 11, it is desirable that the wheels 46 be retractable within the case 11 when not being used.

To accomplish this objective, one end 16 of the case 11 is provided with a spaced pair of recesses 50, preferably at the end 16 to which the support arms 36 are connected. The recesses 50 communicate with the end 16 at the bottom 20 of the case 11. The sides 14 and a plate 52 spaced from the wall 14 and secured to the walls 14 and 15 define the recess 50. It will be apparent that it is most desirable to provide a barrier between the recess 50 and the interior 54 of the luggage case 11 both to enhance the security of the case and to prevent the contents of the case from interfering with operation of the wheel 46.

Figure 5:
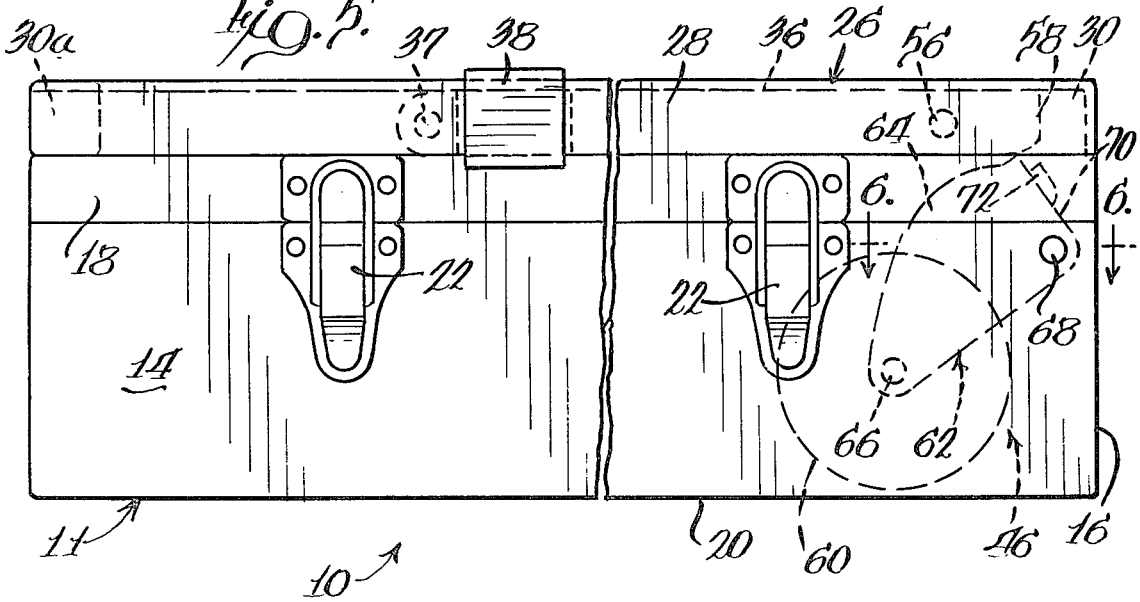
FIG. 5 is a fragmentary elevation of one side of the case of FIG. 1, with some parts shown in phantom lines.

As seen in FIG. 5, the pivot point 56 of each support arm 36 is spaced from the end 58 thereof. The wheel assembly 46 comprises a wheel 60 rotatably mounted to a wheel support member, generally designated 62, which includes a pair of spaced plates 64 receiving, at their lower ends, an axle 66 of the wheel 60. The wheel support 62 is pivotally mounted within the recess 50 by a pin 68 extending through the side wall 14 and the interior wall 52. A top support wall 70 extends between spaced walls 64 and includes a raised projection 72. The projection 72 includes an abutment face **72*a* facing away from the end 16 of the case. A spring 74 is secured to and extends between the wall 52 and an intermediate point of the inner wheel support plate 64**.

Figure 6:
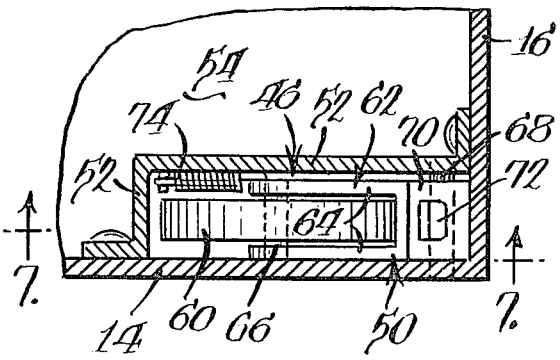
FIG. 6 is a top section taken along line 6—6 of FIG. 5.
Figure 7:
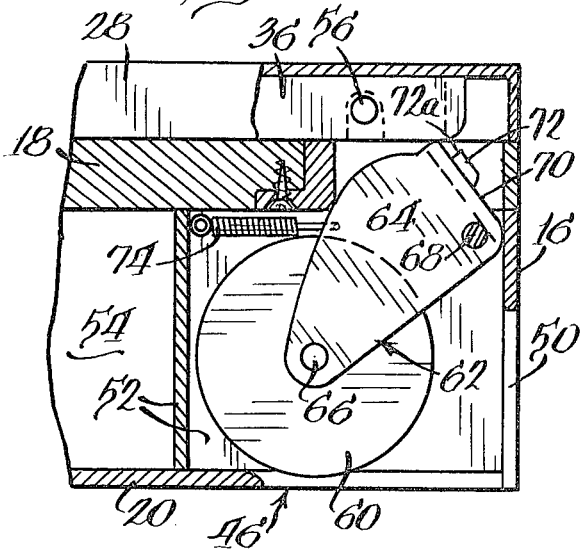
FIG. 7 is a vertical section taken along line 7—7 of FIG. 6, with the framework shown in its retracted position.

FIGS. 5–7 show the wheel assembly 62 in its retracted position within the recess 50. Retraction of the wheel assembly 62 is possible only when the frame support arms 36 are aligned with the lid 18, allowing the coil spring 74 to rotate the plates 64 about the pin 68.

Figure 9:
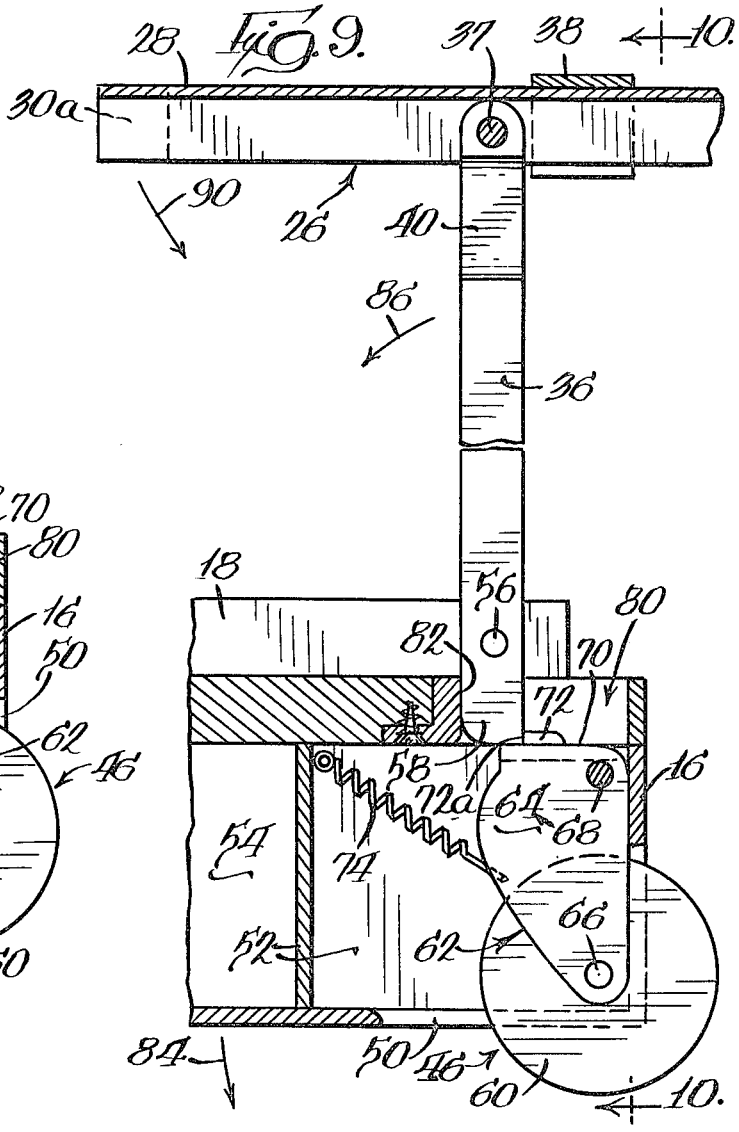
FIG. 9 is a vertical section similar to those of FIGS. 7 and 8 with the support arms and the wheel structure shown in fully extended positions.
Figure 8:
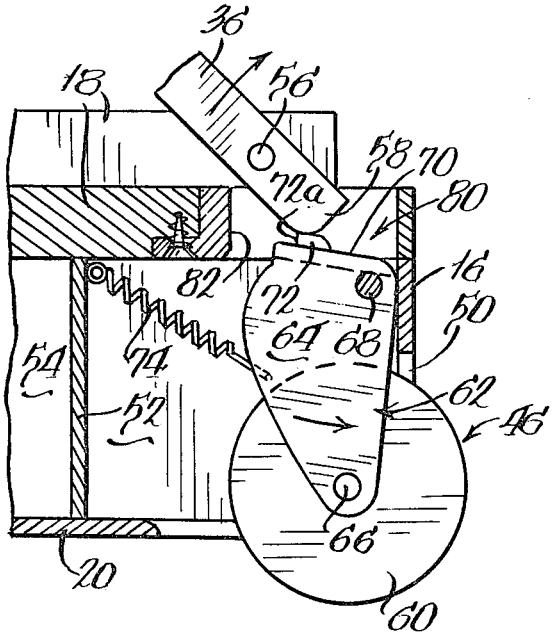
FIG. 8 is a vertical section similar to that of FIG. 7 with the framework in its partially extended position and the wheel structure shown partially extended.

Referring now to FIGS. 8 and 9, as the frame support arm 36 is rotated upwardly from the lid 18, the arm end portion 58 travels downwardly through an opening 80 in the lid 18 and contacts the wheel support wall 70, thereby urging the wheel assembly 46 downwardly and out of the recess 50, as shown in FIG. 8. As the frame support arms 36 gain a substantially perpendicular position with respect to the lid 18, further motion is prevented by contact with an interior wall 82 and the support arm ends 58 become captured between the abutment wall **72*a* of the wheel support and the interior wall 82**.

As seen in FIG. 9, with the support arm 36 perpendicular to the lid 18, the wheel support 62 is aligned with and abuts the end wall 16 of the case 11 with the wheels 60 extending outwardly and downwardly through the recess 50. Thus extended, the wheels 60 provide solid support for the case and trolley framework, since withdrawal of the supported wheel 60 into the recess 50 is prevented by the support end 58 which bears against the wheel support wall 70.

During use, the weight of the case 11 and of supported luggage provides a downwardly directed force in the direction of the arrow 84, thus maintaining the end 58 of the arm 36 in abutment with the wall 82. Retraction of the wheel 60 is effected by movement of the support arm 36 in the direction of the arrow 86 which will not occur during use since operating forces are directed oppositely.

Referring now to FIGS. 9–12, locking engagement of the rigid frame 26 with the support arms 36 is illustrated. From the position of FIG. 9, also seen in FIG. 10, the rigid frame 26 is rotated in the direction of the arrow 90, to place the frame 26 in the coplanar relationship with the parallel arms 36. As seen in FIG. 12, the side channel 28 extends the entire width of end channel 30*a* resulting in a relieved, open end 92 which accommodates support 36 and permits the support to be contained completely within the side channel 28.

The locking slide 38 will then fall, by gravity, from its position adjacent reduced section 40 into abutment with channel 30*a* whereupon inwardly directed lips 38*a* engage support arms 36 and prevent relative motion between the frame 26 and the arms 36. Disengagement is accomplished by moving the locking slide 38 into alignment with the reduced sections 40 of the arm 36.

It is apparent that the combined portable case and trolley structure of FIGS. 1–12 may be quickly and simply converted from the otherwise conventional portable case of FIG. 1 into a luggage trolley simply by disengaging the rigid frame 12 from the periphery of the case lid 18 and rotating the support arms 36 into perpendicular alignment with the lid 18 which simultaneously extends the spaced wheel assemblies 46. The support arms are quickly snapped into the position of FIG. 9, followed by alignment of the rectangular frame 26 with the arms 36 as shown in FIGS. 11 and 12. Luggage, such as luggage 48 of FIG. 4, may then be placed on the lid 18 and retained against the framework 12 for rolling movement, supported by the wheel 46. Upon arrival at a destination and removal of the luggage 48, the extended trolley framework 26 and 36 may easily be disengaged and replaced upon the case lid 18 which simultaneously retracts the wheel assemblies 46.

Figure 13:
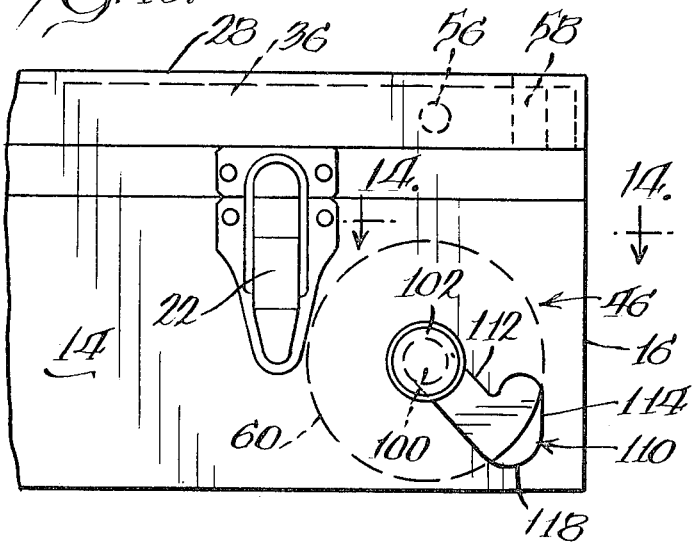
FIG. 13 is a fragmentary elevation of a portion of a further embodiment of the portable case.
Figure 14:
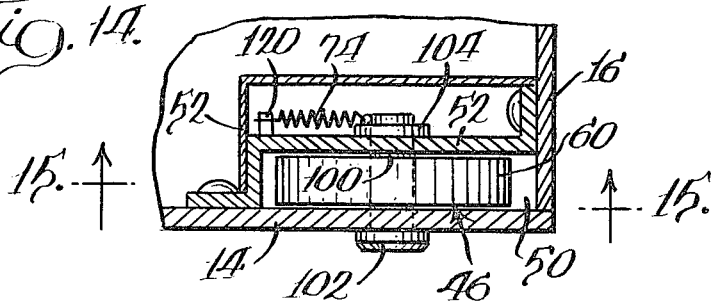
FIG. 14 is a vertical section of the embodiment of FIG. 13 taken along line 14—14 thereof.
Figure 15:
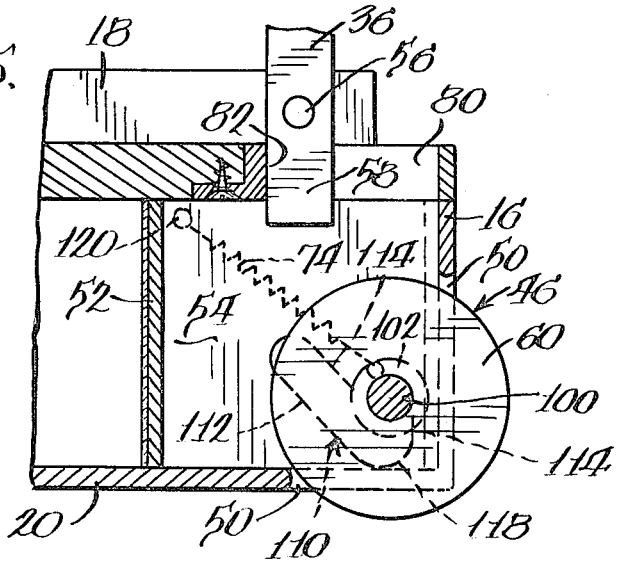
FIG. 15 is a vertical sectional view of the wheel structure of FIG. 14 taken along line 15—15 thereof.

With reference now to FIGS. 13–15, an alternative form of wheel assembly usable with the trolley case of the invention is shown. (Except as noted, elements of the case and trolley of FIGS. 13–15 are identical to those of FIGS. 1–12 and retain identical reference numerals.) In FIGS. 13–15, the wheel assembly 46 is not associated with the rotatable support arm 36 and must be manually extended and retracted. The wheel 60 is fixed to a rotatable spindle 100 having an enlarged head 102 disposed externally of the side wall 14. The spindle 100 extends through the interior wall 52 and is retained in place thereon by a washer 104.

Formed in the walls 14 and 52 are aligned cam slots, generally designated 110, including a diagonal portion 112 extending upwardly and rearwardly from the case end wall 16 and a vertical portion 114 extending generally parallel to the end wall 16 from an elbow 118 at the lowest terminal point of the portion 112.

The spring 74 extends from the point 120 on the interior wall 52 to the spindle 100 to provide a force directed upwardly in the direction of the cam slot diagonal portion 112.

When not in use, the wheel assembly 46 is in the position of FIGS. 13 and 14 with the spring 74 retaining the spindle 100 against the uppermost extension of the slot 112. When it is desired to use the trolley framework 12, each wheel assembly 46 is easily extended from the recess 50 by sliding movement of the enlarged head 102 towards the elbow 118 and into the vertical cam portion 114, where it is retained by the force of the spring 74. Retraction of the wheel assembly 46 is easily accomplished by pushing the enlarged head 102 to align the spindle 100 with the cam slot diagonal 112 whereupon the force of the spring 74 returns the wheel assembly 46 to the position of FIGS. 13 and 14.

Figure 16:
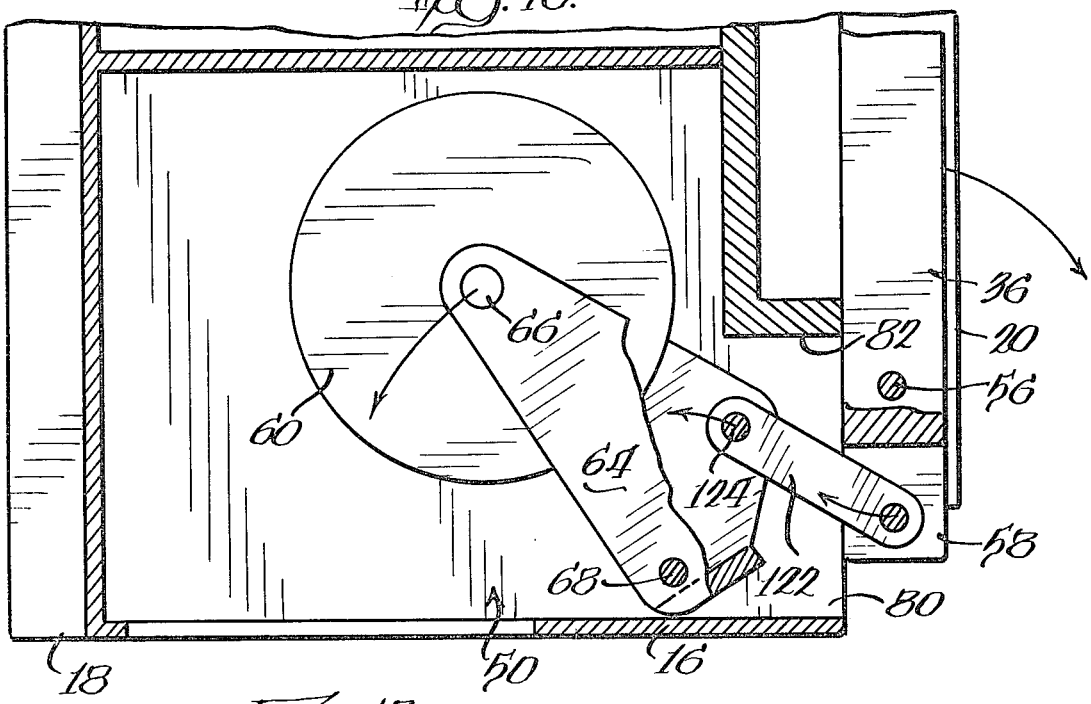
FIG. 16 is a vertical section of yet another embodiment of the wheel structure of the invention.
Figure 17:
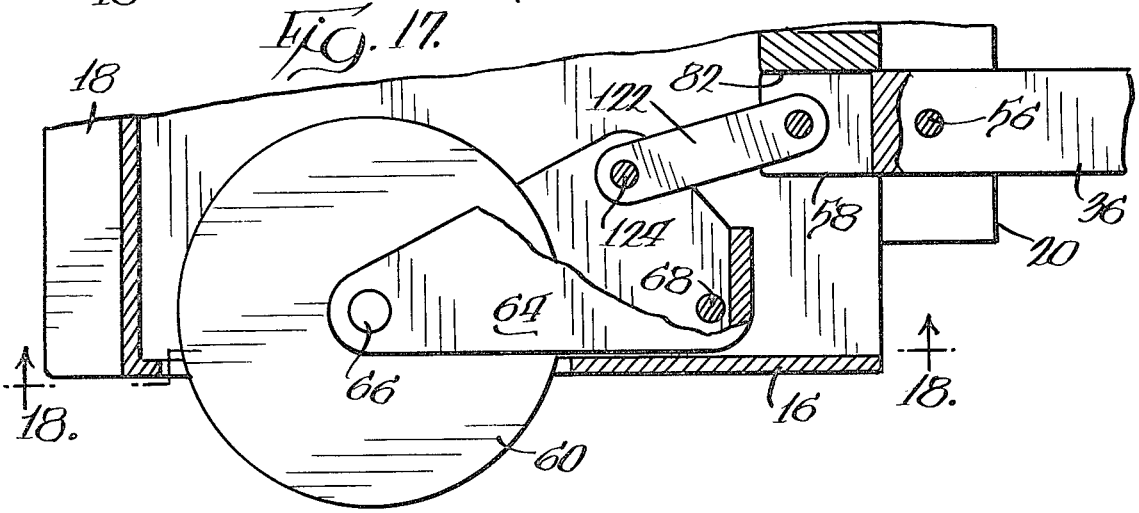
FIG. 17 is a vertical section of the wheel structure of FIG. 16 shown in an extended position.
Figure 18:
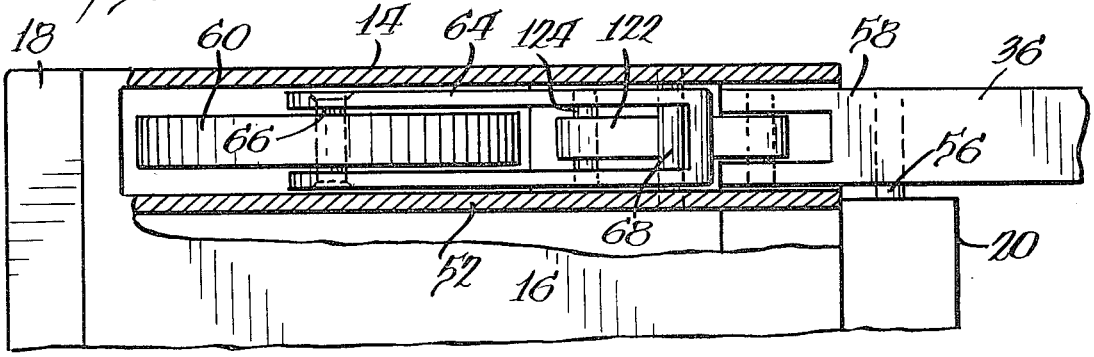
FIG. 18 is a vertical section of the extended wheel structure of FIG. 17 taken along line 18—18.

Another modified embodiment of the wheel assembly of the invention is illustrated in FIGS. 16–18. As in FIGS. 5–10, the wheel assembly of FIGS. 16–18 is so associated with the frame support arms as to be extendable from the case recess in response to pivoting of the support arms into perpendicular relationship with the case 11.

Unlike FIGS. 5–10, however, the framework 12 cannot be located on the case lid 18. Because the support arms 36 are non-releasably attached to the wheel support 64 by means of a pinned connecting link 122, the framework 12 and wheel support 64 must be attached to portions of the case 11 which do not move relative to each other.

The case of FIGS. 5–10 has therefore been slightly modified by mounting the framework 12 on the bottom 20 rather than the lid 18 of the case and by increasing the depth of the case 11 so that the wheel 60 extends only through the case end wall 16 rather than a corner as shown in FIG. 8.

The wheel assembly of FIGS. 16–18 is very similar to that of the embodiment of FIGS. 5–10 but does not rely on engagement of the support arm end 58 with a cam-like projection on the wheel support means 46. Rather, the frame support arm end 58 is pivotally connected to one end of a link 122. The opposite end of the link 122 is similarly pivotally connected to the wheel support means 64 so as to provide an over-toggle action on the wheel support 64 as the frame support arms 36 are rotated from the closed position of FIG. 16 to the open position of FIG. 17.

This is generally accomplished by directing the link inwardly and downwardly from the rear wall 16 toward the interior of the recess 50 such that rotation of the arms 36 upwardly from the case bottom 20 drives the end portion 58 downwardly into the recess 50 through the opening 80, providing a downwardly directed force against the wheel support 64. As the support arm end 58 continues its downward travel, it crosses over a centerline between the support arm pivot point 56 and the pivot 124 on the wheel support 64, thereby driving the support 64 outwardly toward the end wall 16 as well as downwardly. It is apparent that during use, the frame support arm end portion 58 will be securely retained against the abutment wall 82 by a force much greater in magnitude than that exerted against the wheels 60. Upon removal of luggage from the case bottom 20, the wheels may be retracted by rotation of the support arms 36 to their closed position which will supply a pulling force to the link 122 by the upwardly rotating support arm end 58 which in turn will supply an upward force to the wheel support 64.

Figure 19:
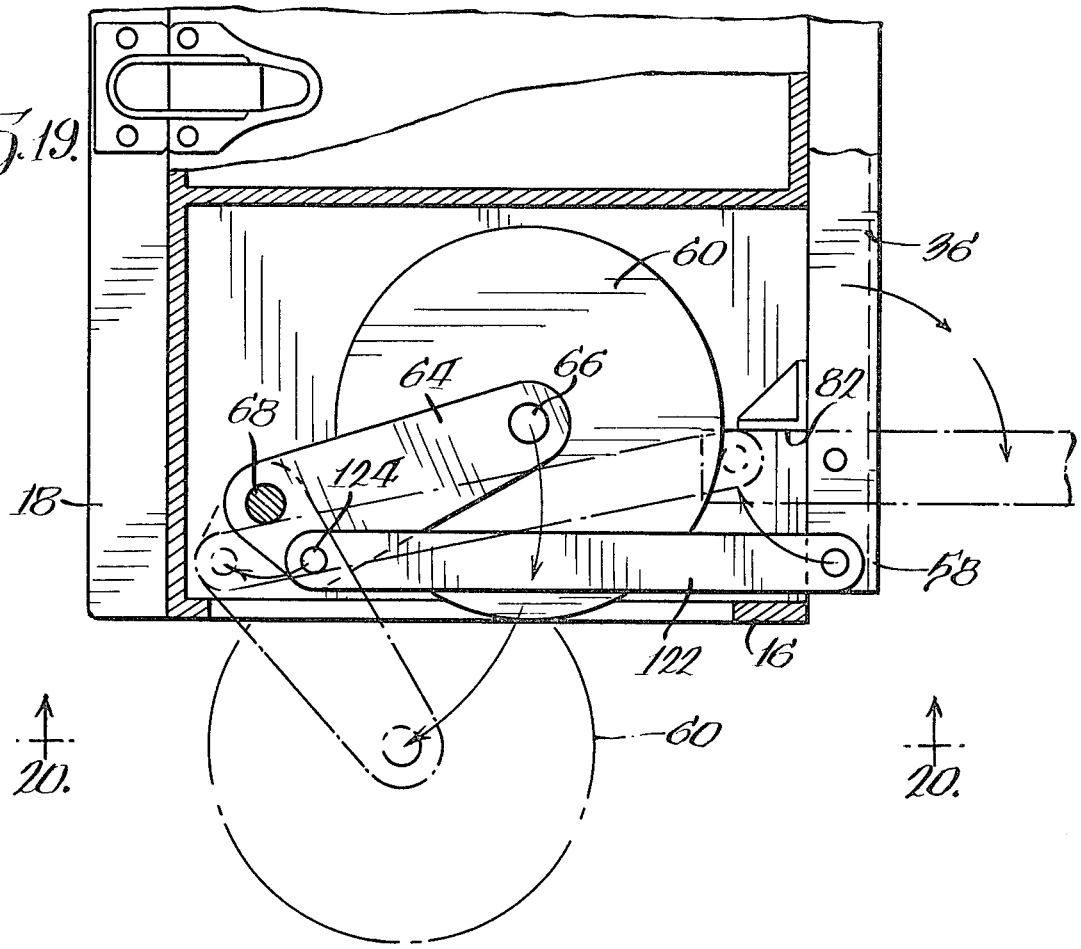
FIG. 19 is a vertical section of the luggage case depicting a modified embodiment of the wheel structure of FIG, 16.
Figure 20:
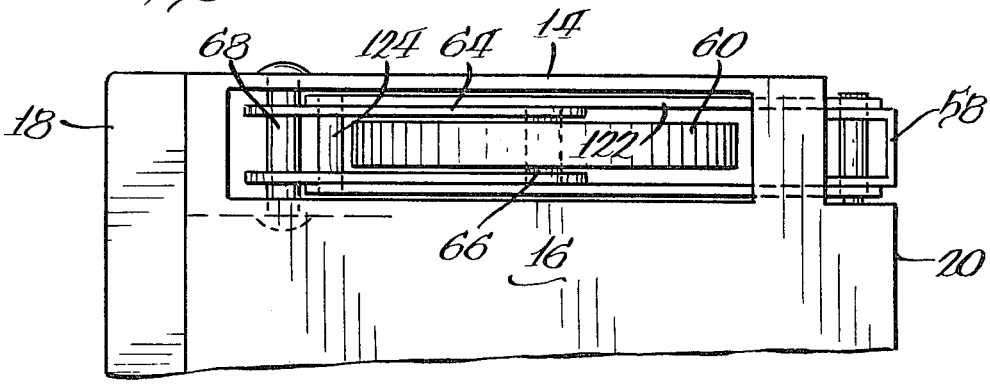
FIG. 20 is a vertical section of the wheel structure shown in FIG. 19 taken along line 20—20.

FIGS. 19 and 20 illustrate a version of the linkage system of FIGS. 16–18 modified to accomplish a greater extension of the wheel 60 from the case 11 than is possible with the mechanism of FIGS. 16–18.

In FIG. 19, the location of the wheel support pivot 68 has been changed to permit the wheel 50 to extend through a recess 50 in only the end wall 16 without greatly increasing the depth of the case 11. Also, the pivot connection 124 between the link 122 and the wheel frame 64 has been moved closer to the wheel support pivot 68. The result of this modification is that the same motion of support leg 36 as was present in FIGS. 16–18 will cause a greatly increased arcuate travel of the wheel support 64 (and wheel 60) around its pivot 68.

As shown by the dashed lines in FIG. 19, wheel 60 extension is much greater than that obtained through use of the mechanism of FIG. 17.

As with the arrangement explained above, an over-toggle relationship is present between the wheel support 64 and the support arm end 58 which cause forces acting on the wheels 60 to be directed in a manner which will tend to force the support end 58 toward the stop 82, thus locking the arms 36 in the open position.

Other features and advantages of the invention will be apparent from the foregoing description and from the drawings. While illustrative embodiments of the invention are shown in the drawings and have been described in detail herein, the invention is susceptible of embodiment in many different forms, and it should be understood that the present disclosure is to be considered as an exemplification of the principles of the invention and not intended to limit the invention to the embodiments illustrated.

We claim:

1. A portable case having a folding framework which is associated with a face of said case to provide the appearance of a conventional case and which can be moved to an operative position for moving said case on wheels associated therewith comprising:

a rigid rectangular frame having rigidly interconnected side and end members and substantially the same length and width as said face to be of a size to have said hollow frame lie adjacent said face when folded;

means mounting said frame for movement to an operative position spaced from and generally perpendicular to said case including a pair of arms pivotally connected between said case and said frame, said arms extending in coplanar relation with said frame in both the folded and operative positions of said frame; and means for releasably locking said frame and arms together in said parallel relation.

2. A portable case having a folding framework which may be extended to form a wheeled trolley which may be rolled along the ground to transport luggage, comprising:

a case having top and bottom faces, side walls and end walls;

wheel means located adjacent said bottom face to engage the ground thereby permitting said case to be easily rolled;

a pair of support arms, one end of each pivotally connected to each of said case sides adjacent one of said case ends for selective movement between a closed position wherein said arms are substantially parallel to and in proximity with said top face and an open position wherein said arms are substantially perpendicular to said top face;

a frame pivotally connected to said support arms adjacent the other ends thereof and which engages said top face when said support arms are in said closed position and which may be pivoted to a position of coplanar alignment with said support arms when said arms are in said open position.

3. The portable case of claim 1 or 2 further including a ledge around the periphery of said top face conforming to the cross-sectional shape of said frame to receive said frame and said support arms such that said frame and said top surface define a substantially flat surface when said support arms are in said closed position, said support arms being pivotally connected to said case at said ledge.

4. The portable case of claim 3 wherein said frame comprises channel members including legs extending parallel to said sides and ends when said arms are in said closed position and forming a substantially continuous extension of said top face when said arms are closed; said support arms being pivotally connected between said legs of said channels and received within said channels when in said closed position.

5. The portable case of claim 2 including locking means to releasably secure said frame to said support arms when said arms are in said open position and said frame is pivoted into said coplanar alignment with said support arms.

6. The portable case of claim 1 or 5 wherein said arms include reduced sections adjacent said frame to arm pivot and said locking means comprises a C-shaped slide including side legs, a web containing said legs and flanges extending toward each other from said side legs, said slide surrounding said frame and movable between positions wherein said flanges engage said support arms to retain said arms and frame in said coplanar alignment when in said operative position and wherein said flanges cooperate with said reduced sections to permit said frame to rotate about said pivot relative to said support arms.

7. The portable case of claim 6 including recesses located in said case to receive and capture said locking slides when said arms are in said closed position.

8. The portable case of claim 7 including stop means located adjacent said support arm to case pivot to prevent said arms from being moved beyond a position substantialliy perpendicular to said case face.

9. The portable case of claim 8 wherein said stop means includes:

an extension of said support arms beyond said arm to case pivot;

openings in said case face communicating with the interior of said case, said arm extensions being received by said openings as said arms are moved from said closed to said open position; and interior walls within said openings positioned to contact said support arm extensions when said arms have been moved to the open position thereby preventing further movement of said arms.

10. A folding trolley and portable case having a foldable framework which is associated with the case to provide the appearance of a conventional case comprising:

a rectangular case with a perimetral ledge provided at one face thereof;

a rigid rectangular hollow frame having rigidly interconnected side and end members and substantially the same length and width as said face to be of a size to have said side and end members fit onto said ledge and lie flush with said face;

means mounting said frame for movement to an operative position spaced from and generally perpendicular to said case including a pair of arms pivotally connected between said case and said frame, said arms extending in the same direction as said frame when the latter is in said operative position; and means for releasably locking said frame and arms together in said operative position.

11. A portable case having a framework which can be extended from the case to form a wheeled trolley to retain luggage between the extended framework and the case, comprising:

a luggage case including a top face for supporting luggage, a bottom face, side walls and end walls;

a rigid continuous frame selectively engageable with said top face;

a pair of spaced coplanar frame support arms having one end of each pivotally connected to said frame and the other end of each arm pivotally connected to said case adjacent an end thereof for pivotal movement between a closed position wherein said arms engage said top face and an open position wherein said arms extend substantially perpendicular to said top face, said frame being rotatable about said support arms to a position of coplanar alignment with said arms; and a spaced pair of wheels mounted on said case adjacent said end adjacent said support arm connection for rolling support of said case and luggage carried thereon.

12. The case of claim 11 wherein said wheels are mounted within said case in recesses formed in one end of said case, each recess including an opening in said case end for passage and selective extension of said wheels.

13. The case of claim 12 wherein said wheels are rotatably carried by support means pivotally mounted within each of said recesses for movement between a recessed position wherein said wheels and supports are entirely enclosed within said recesses and an extended position wherein said supported wheels extend outwardly of said recesses to support said case.

14. The case of claim 13 wherein said wheel support means are resiliently biased toward said recessed position and said support arms include wheel extension means to urge said wheel support means to their extended positions in response to pivoting of said frame support arms to said open position.

15. The case of claim 14 wherein each of said wheel support means has a cam surface, said case top face has a pair of openings communicating with said recesses, and each of said frame support arms has an end portion extending from said arm to case pivot adjacent said openings, said frame support arms extending through said openings and into engagement with said wheel support means cam surface to rotatably urge each said wheel support means toward said extended position as said arms are rotated to said open position.

16. The case of claim 15 wherein said case and said wheel support cam surfaces carry respective abutment stop means spaced to capture a frame support arm end portion when said arms are substantially perpendicular to said case face to retain said arms and said face in said perpendicular relationship.

17. The case of claim 13 wherein said wheel extension means includes an end of said support arms extending from said arm to case pivot toward said case end, and a connecting link pivotally attached to said arm end and said wheel support means, whereby movement of said support arm toward said open position causes rotation of said wheel support means and causes said link to arm pivot to rotate beyond a line between said link to wheel support pivot and said arm to case pivot thereby effecting an over-toggle rotation which retains said arms in said open position and urges said wheel support means toward said recess opening.

18. The combined case and trolley of claim 13 wherein each said wheel is carried on an axle received in a cam slot having a first portion extending diagonally downwardly from said face toward said case end and a second portion extending toward said face from an elbow at the lowest point of said first slot portion and forming an abutment stop, and a spring extends between said axle and said case to selectively urge said axle toward said face in said first slot portion and to selectively retain said axle against said abutment stop, whereby said axle may be selectively positioned and retained within said respective first and second portions corresponding to retracted and extended positions of said wheel, respectively.

19. A portable case having a framework which can be extended and wheels which may be extended to form a luggage trolley which may be rolled along a surface, comprising:

a case having top and bottom surfaces, side walls, and end walls and including a peripheral ledge;

a pair of support arms, one end of each being pivotally connected to said case within said ledge and adjacent an end of said case, for selective movement between a closed position adjacent and parallel to said case top surface and an open position substantially perpendicular to said case top surface;

a continuous generally rectangular frame conforming to said ledge configuration and having side elements with a U-shaped cross section including a crosspiece and depending side legs pivotally connected to the other ends of said support arms, said frame engaging said ledge when said support arms are in said closed position, the frame being oriented such that said depending legs receive said support arms and said crosspieces form a substantially flat extension of said top surface when said support arms are in said closed position, said frame being rotatable to a position of coplanar alignment with said support arms when said support arms are in said open position; and a pair of locking slides on said frame adjacent each support arm connection movable to a position surrounding said support arms preventing rotation of said frame relative to said support arms.

20. A portable case having a folding framework which can be extended and wheels which may be extended to form a luggage trolley which may be rolled along a surface, comprising:

a case having top and bottom surtaces, side walls, and end walls and including a peripheral ledge;

a pair of support arms, one end of each being pivotally connected to said case within said ledge and adjacent an end of said case, for selective movement between a closed position adjacent and parallel to said case top surface and an open position substantially perpendicular to said case top surface;

a continuous generally rectangular frame conforming to said ledge configuration and having side elements with a U-shaped cross section including a crosspiece and depending side legs pivotally connected to the other ends of said support arms, said frame engaging said ledge when said support arms are in said closed position, the frame being oriented such that said depending legs receive said support arms and said crosspieces form a substantially flat extension of said top surface when said support arms are in said closed position, said frame being rotatable to a position of coplanar alignment with said support arms when said support arms are in said open position;

a locking slide on said frame adjacent each support arm connection having two depending legs, a web connecting said legs and two projections extending parallel to said web and towards each other from said legs movable to a position surrounding said frame wherein said projections engage said support arm thereby preventing rotation of said frame relative to said support arms;

reduced sections on said support arms shaped to accommodate said slide projections when said slide is moved adjacent said reduced sections and permit rotation of said frame relative to said arms;

dual recesses formed inside said case adjacent said side walls and opening through the case end wall at which said arms are pivoted defined by said case side walls and interior walls spaced from said side walls, including aligned generally L-shaped slots formed in said side walls and said interior walls, the longer leg of said slots extending generally away from said end wall opening and said shorter leg extending from said longer leg toward said top surface;

wheels within said recesses journaled on axles located in each of said recesses and extending from said side wall slot to said interior wall slot, said axles including means to retain said axles in said slots, whereby said wheels may be moved between a retracted position wherein said axles are located in said longer legs of said slots and said wheels are inside said case recesses and an extended position wherein said axles are located in said shorter slot legs and said wheels project from said recesses; and springs attached to each of said axles and said case at points between said longer slot and said top surface and remote from the case end opening thereby retaining said axles in either the retracted or extended positions.

* * * * *